US006786048B2

(12) United States Patent
Tiemann

(10) Patent No.: US 6,786,048 B2
(45) Date of Patent: Sep. 7, 2004

(54) THERMAL SHIELD FOR A COMPONENT CARRYING HOT GASES, ESPECIALLY FOR STRUCTURAL COMPONENTS OF GAS TURBINES

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/182,336

(22) PCT Filed: Jan. 25, 2001

(86) PCT No.: PCT/DE01/00300

§ 371 (c)(1),
(2), (4) Date: Jul. 26, 2002

(87) PCT Pub. No.: WO01/55273

PCT Pub. Date: Aug. 2, 2001

(65) Prior Publication Data

US 2003/0021675 A1 Jan. 30, 2003

(30) Foreign Application Priority Data

Jan. 28, 2000 (DE) ..... 100 03 728

(51) Int. Cl.[7] ..... F02C 1/00
(52) U.S. Cl. ..... 60/752
(58) Field of Search ..... 60/752, 753, 800, 60/799; 431/353

(56) References Cited

U.S. PATENT DOCUMENTS

| | | | | | |
|---|---|---|---|---|---|
| 1,756,031 | A | | 4/1930 | Leach | |
| 2,348,833 | A | * | 5/1944 | Miller | 285/228 |
| 2,955,415 | A | * | 10/1960 | Long | 239/127.1 |
| 5,265,411 | A | * | 11/1993 | Belsom | 60/796 |
| 5,799,491 | A | * | 9/1998 | Bell et al. | 60/752 |
| 6,397,765 | B1 | * | 6/2002 | Becker | 110/336 |
| 6,450,762 | B1 | * | 9/2002 | Munshi | 415/138 |
| 2003/0056516 | A1 | * | 3/2003 | Hadder | 60/772 |
| 2003/0079475 | A1 | * | 5/2003 | Schmahl et al. | 60/752 |
| 2003/0089115 | A1 | * | 5/2003 | Gerendas | 60/796 |

FOREIGN PATENT DOCUMENTS

| | | |
|---|---|---|
| EP | 0624757 | 11/1994 |
| EP | 0843090 | 5/1998 |
| WO | 9813645 | 4/1998 |

* cited by examiner

*Primary Examiner*—Ehud Gartenberg
(74) *Attorney, Agent, or Firm*—Harness, Dickey & Pierce, P.L.C.

(57) ABSTRACT

A hot gas chamber, for example a combustion chamber of a gas turbine installation, is lined with thermal shield elements. A closed-circuit cooling system is provided by configuring the thermal shield element as a hollow body into which cool air flows via a cool air supply channel. Once the cool air is discharged from the thermal shield element through at least one opening, it is collected in a tiled intermediate space and is then used for the combustion process.

20 Claims, 3 Drawing Sheets

THERMAL SHIELD FOR A COMPONENT CARRYING HOT GASES, ESPECIALLY FOR STRUCTURAL COMPONENTS OF GAS TURBINES

This application is the national phase under 35 U.S.C. § 371 of PCT International Application No. PCT/DE01/00300 which has an International filing date of Jan. 25, 2001, which designated the United States of America and which claims priority on German Patent Application No. 100 03 728.3 filed Jan. 28, 2000, the entire contents of which are hereby incorporated by reference.

FIELD OF THE INVENTION

The invention generally relates to an arrangement of thermal shield elements for a structure carrying hot gas, especially a metallic component of a gas turbine plant or combustion chamber. The arrangement may include a plurality of thermal shield elements which are arranged next to one another on a supporting structure in such a way as to cover the surface, and which are anchored to the structure.

BACKGROUND OF THE INVENTION

On account of the high temperatures prevailing in hot gas spaces, it is necessary to protect a supporting structure which is exposed to hot gas. To this end, it is possible, for example, to line the hot gas space with thermal shield elements whose surface facing the hot gas is cooled.

A thermal shield element with cooling fluid return and thermal shield arrangement for a component carrying hot gas is described in DE-U-297 14 742.0. The thermal shield component consists of a hollow arrangement with an outer shell and a small, hollow insert. Between the insert and the outer shell there is an intermediate space through which the cooling fluid can flow. The insert has passage openings for the cooling fluid on the base side. A closed-circuit cooling-fluid system is achieved by virtue of the fact that the cooling fluid flows through passages in the supporting structure into the insert, flows from there through passage openings into the outer shell—the cooling is effected in the process by impingement cooling and convection cooling—and flows back from there through separate outlet passages in the supporting structure. The multi-shell construction of the thermal shield element ensures the closed-circuit cooling-fluid system. However, such a multi-shell construction is very expensive.

A combustion chamber and a method for the steam cooling of a combustion chamber are proposed in DE 197 51 299 C2. In this case, the supporting structure of the combustion chamber consists of an inner, an intermediate and an outer wall. The cooling fluid, in particular cooling steam, flows through an inlet into an outer cooling space, flows from there through openings in the intermediate wall into an inner cooling space and flows from there to the outlet. The cooling of the inner wall is effected by impingement cooling when the cooling fluid passes over through the openings of the intermediate wall from the outer cooling space into the inner cooling space, whose wall facing the hot gas constitutes the inner wall to be cooled, and by convection cooling by the fluid flowing in the direction of the outlet. In this case, a cooling-fluid circuit is constructed by the multi-shell construction of the outer wall. Such a multi-shell construction of the combustion-chamber casing is expensive. In addition, the use of steam as cooling fluid requires the cooling steam to already be produced during the start-up of the turbine and to be fed back into the process.

SUMMARY OF THE INVENTION

An object of an embodiment of the invention is to specify a thermal shield arrangement which permits an economical operation of the plant. According to demand, an economical operation may primarily require low losses of cooling medium, low generation of noise, a high efficiency or a simple and easy-to-assemble design.

According to an embodiment of the invention, in a thermal shield element of the type specified at the beginning, a thermal shield element can be a single-shell hollow body which has a cooling-air feed passage and at least one opening for the discharge of the cooling air into a tiled intermediate space which is located between the individual thermal shield elements. Such a single-shell construction is substantially simpler in terms of design than the construction of multi-shell thermal shield elements already known.

A closed-circuit cooling-air system can be achieved in this arrangement by the cooling air flowing through the cooling-air feed passage in the supporting structure into the interior of the hollow body, where that surface of the hollow body which faces the hot gas is cooled, for example by use of an impingement-cooling plate. After the cooling air flows out into the tiled intermediate space, the air collected there can be used for the combustion.

Further minimization of the cooling-air consumption can be achieved by expansion gaps being located between the thermal shield elements, sealing elements, preferably checker metal sheets, sitting in said expansion gaps. The outflow of the cooling air from the hollow body through the at least one opening, in addition to the cooling of the lateral edges of the hollow body itself and the cooling of the adjacent thermal shield element, also ensures the cooling of the sealing element.

A thermal shield element of the arrangement can be preferably anchored under prestress to the supporting structure. Such anchoring secures the position of the thermal shield element against rotation, in particular at the hot/cold transitions often occurring during operation and during the expansion and contraction processes associated therewith of the components of the arrangement which are involved.

The sealing elements can advantageously sit in slots of the thermal shield elements, with a clearance being left in the transverse direction of the slot. As a result, adjacent thermal shield elements, after the anchoring between thermal shield element and supporting structure has been released, can be displaced relative to one another in the direction of the sealing elements—i.e. in the transverse direction of the slot. A thermal shield element can be dismantled and removed from the hot gas side by releasing its anchoring to the supporting structure and that of the adjacent thermal shield elements, by pushing the adjacent thermal shield elements away from the thermal shield element to be removed, while utilizing the abovementioned clearance, and by removing the thermal shield element to be dismantled.

BRIEF DESCRIPTION OF THE DRAWINGS

An exemplary embodiment of a thermal shield arrangement is specified below. In the drawings.

DETAILED DESCRIPTION OF THE PREFERRED EMBODIMENTS

Figure 1:
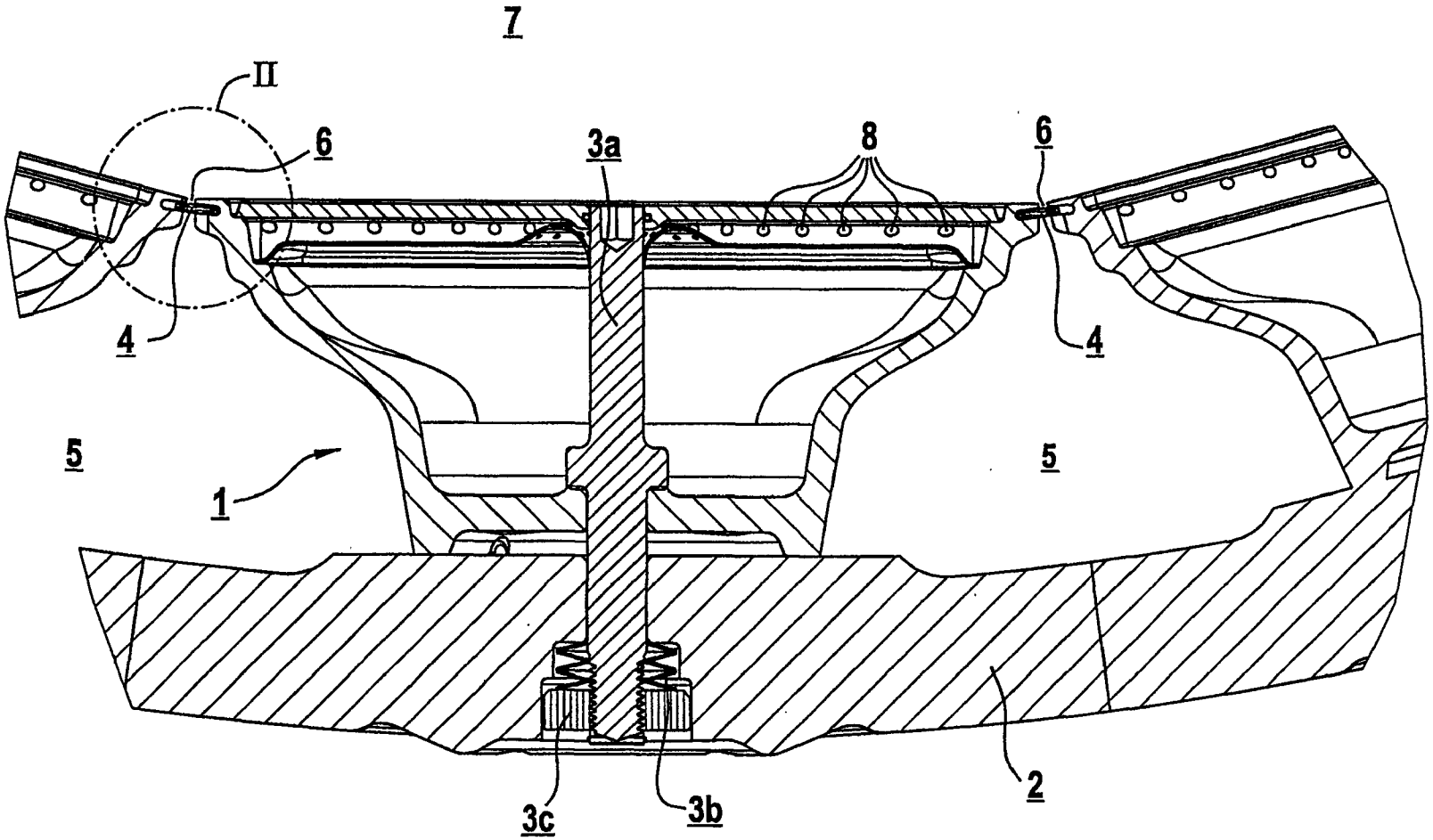
FIG. 1 shows a longitudinal section through the center of a thermal shield element with supporting structure, including the anchoring of the thermal shield element to the supporting structure.

FIG. 1 shows a thermal shield element 1 which is shown cutaway longitudinally in the center. The thermal shield element 1 is anchored to the supporting structure 2 by tension bolting for example. The tension bolting advantageously includes a central fastening bolt 3*a* which has an external thread, one or more disk springs 3*b* and a nut 3*c*. The tension bolting prestresses the thermal shield element 1 against the supporting structure 2 and is held in tension by one or more disk springs 3*b*. The thermal shield element 1 is secured in its position by the prestressing thus achieved. Sealing elements 4 prevent the inflow of cooling air from the tiled intermediate space 5 through the expansion gap 6 into the combustion chamber 7. An opening 8 for the discharge of the cooling air from the hollow body of thermal shield 1 into the tiled intermediate space 5 is preferably realized by sectional openings provided all round on the side wall of the thermal shield element. These sectional openings are preferably provided close to the hot gas side, so that the cooling of the lateral margins of the thermal shield element itself and also the cooling of the sealing elements 4 and the cooling of the adjacent thermal shield elements is ensured. In addition, such an arrangement of the opening 8 or sectional openings improves the cooling of the side margins of adjacent thermal shield elements, in which case virtually no leakages of cooling air need to be tolerated for this.

Thermal shield elements 1 lying next to one another and separated by an expansion gap 6 can be joined to one another in various ways (e.g. by means of a slot-and-key joint).

Figure 2:
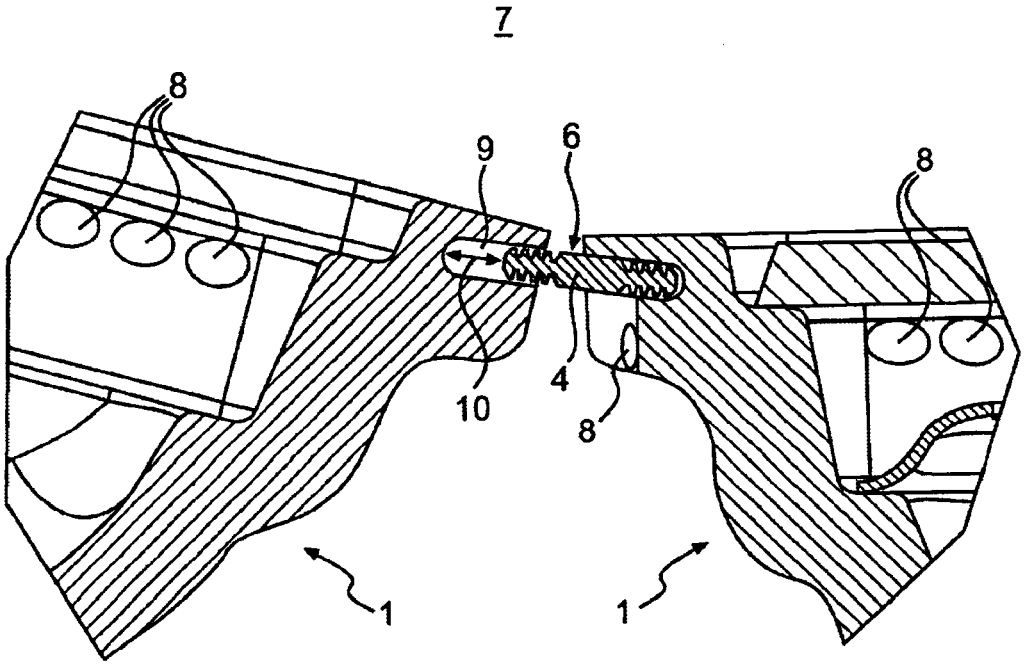
FIG. 2 shows a longitudinal section through two adjacent thermal shield elements in the region of the sealing element between the thermal shield elements.

FIG. 2 shows a sealing element 4 between two adjacent thermal shield elements. The sealing element 4 is preferably designed as a checker metal sheet. The sealing element 4 sits in slots 9 of the thermal shield elements while leaving a clearance 10.

Figure 3:
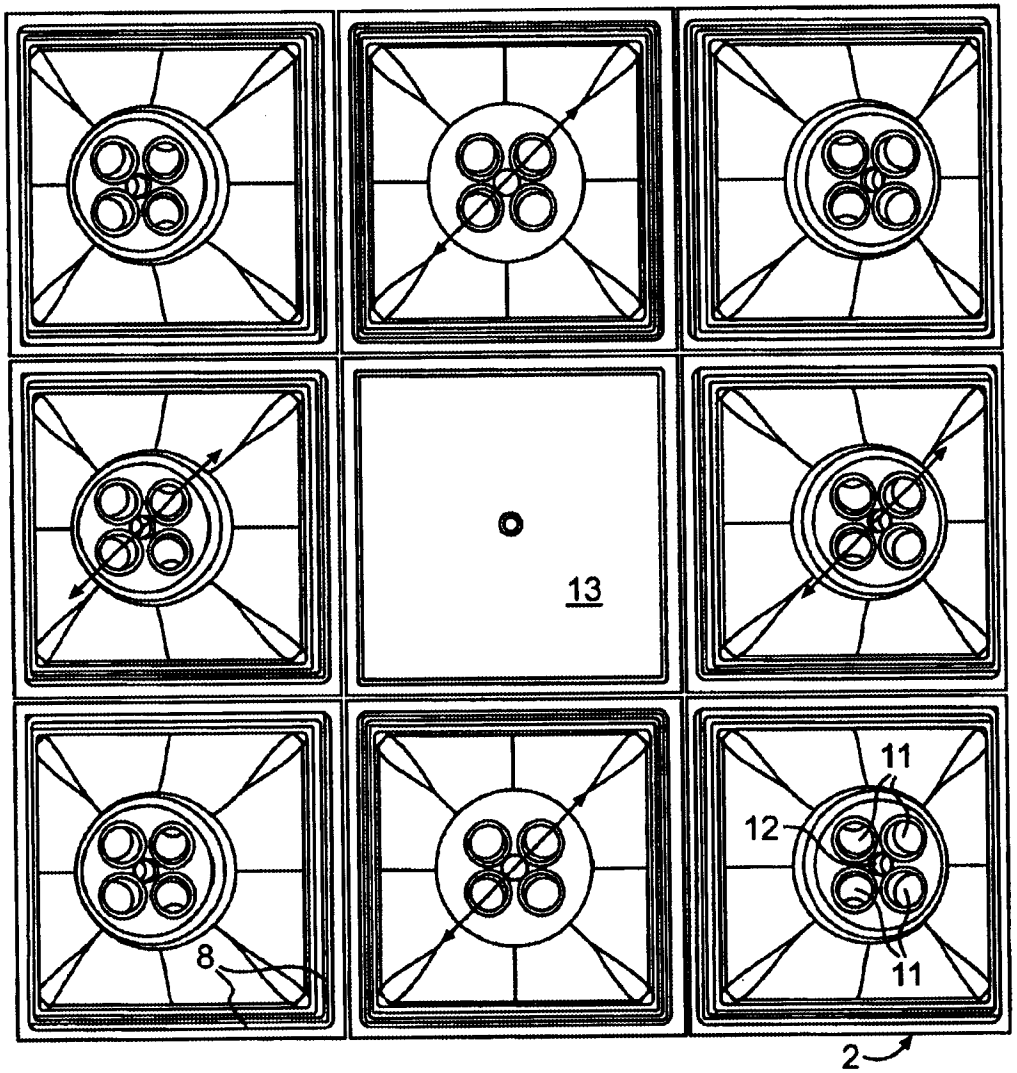
FIG. 3 shows a plan view from the hot gas side of a plurality of thermal shield elements arranged next to one another.

FIG. 3 shows the thermal shield elements, arranged next to one another on a supporting structure 2, as viewed from the hot gas side. Those surfaces of the thermal shield elements which are exposed to the hot gas have been omitted in the drawing in order to permit a view into the interior of the hollow bodies.

The cooling-air feed passage 11 is designed, for example, as four sectional passages. A thermal shield element can be anchored to the supporting structure 2, for example, by a screwed connection passed through the opening 12.

The arrows indicate the direction in which thermal shield elements can be displaced after their anchoring to the supporting structure 2 has been released. In this case, the clearance 10 shown in FIG. 2 is utilized for the displacement of the thermal shield elements. After the anchoring between the four thermal shield elements adjacent to a thermal shield element 13 and the supporting structure has been released, this thermal shield element 13 can be dismantled and removed from the hot gas side. Such accessibility of the thermal shield elements from the hot gas side is advantageous during maintenance work.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thermal shield arrangement, comprising:

a closed-circuit cooling-air system for a structure carrying hot gas, including a plurality of thermal shield elements anchored next to one another on a supporting structure, wherein the thermal shield elements include a hollow body, a cooling-air feed passage and at least one opening for discharge of cooling air into a space located between individual thermal shield elements, wherein expansion gaps are included between thermal shield elements, and wherein sealing elements are arranged in the expansion gaps, the sealing elements being cooled by the cooling air.

2. The thermal shield arrangement of claim 1, wherein the closed-circuit cooling air system is for a gas turbine plant.

3. The thermal shield arrangement of claim 1, wherein the closed-circuit cooling air system is for a combustion chamber.

4. The thermal shield arrangement of claim 1, wherein the sealing elements include checker metal sheets.

5. The thermal shield arrangement of claim 1, wherein the plurality of thermal shield elements are anchored on the supporting structure so as to cover the supporting structure.

6. The thermal shield arrangement of claim 1, wherein the space is a tiled intermediate space located between thermal shield elements.

7. The thermal shield arrangement of claim 1, wherein the hollow body is a single-shell hollow body.

8. The thermal shield arrangement of claim 1, wherein the thermal shield elements are anchored under prestress to the supporting structure.

9. The thermal shield arrangement of claim 1, wherein the sealing elements are arranged in slots of the thermal shield elements, leaving a clearance in the transverse direction of the slot.

10. The thermal shield arrangement of claim 1, wherein the sealing elements are configured in such a way that, after the anchoring between a first thermal shield element and the supporting structure has been released, adjacent thermal shield elements are displaceable relative to one another in the direction of the sealing elements in such a way that the first thermal shield element can be removed from a hot gas side.

11. A combustion chamber including the thermal shield arrangement of claim 1.

12. A cooling-air system for a structure carrying hot gas, comprising:

a plurality of thermal shield elements anchored next to one another on a supporting structure, wherein the thermal shield elements include a hollow body, a cooling-air feed passage and at least one opening for discharge of cooling air into a space located between individual thermal shield elements, wherein expansion gaps are included between thermal shield elements, and wherein sealing elements are arranged in the expansion gaps, the sealing elements being cooled by the cooling air.

13. The cooling-air system of claim 12, wherein the cooling air system is a closed-circuit cooling-air system.

14. A combustion chamber including the cooling-air system of claim 12.

15. The cooling-air system of claim 12, wherein the space is a tiled intermediate space located between thermal shield elements.

16. A thermal shield for a structure carrying hot gas, comprising:

a plurality of thermal shield elements, anchored next to one another onto a supporting structure, wherein the thermal shield elements include a hollow body, a cooling-air feed passage and at least one opening for discharge of cooling air into a space located between individual thermal shield elements, wherein expansion gaps are included between thermal shield elements, and wherein sealing elements are arranged in the expansion gaps, the sealing elements being cooled by the cooling air.

17. A combustion chamber including the thermal shield of claim 16.

18. A cooling-air system including the thermal shied of claim 16.

19. The thermal shield of claim 16, wherein the plurality of thermal shield elements are anchored on the supporting structure so as to cover the supporting structure.

20. The thermal shield of claim 16, wherein the space is a tiled intermediate space located between thermal shield elements.

* * * * *